US005576278A

United States Patent [19]

Van Duzee et al.

[11] Patent Number: 5,576,278

[45] Date of Patent: Nov. 19, 1996

[54] STABLE LIQUID ENZYME COMPOSITIONS AND METHODS OF USE

[75] Inventors: Barry F. Van Duzee, Weatherford; Ralph P. Stone, Arlington, both of Tex.

[73] Assignee: Alcon Laboratories, Inc., Fort Worth, Tex.

[21] Appl. No.: 477,000

[22] Filed: Jun. 7, 1995

[51] Int. Cl.[6] ..... C11D 3/386; C11D 3/02; C11D 3/20

[52] U.S. Cl. ..... 510/114; 510/392; 510/393; 510/530; 435/264; 422/28

[58] Field of Search ..... 252/174.12, DIG. 12, 252/106; 134/42; 422/28; 435/264

[56] References Cited

U.S. PATENT DOCUMENTS

| | | | |
|---|---|---|---|
| Re. 32,672 | 5/1988 | Huth et al. | 252/95 |
| 3,873,696 | 3/1975 | Randeri et al. | 424/153 |
| 3,910,296 | 10/1975 | Karageozian et al. | 134/2 |
| 3,931,319 | 1/1976 | Green et al. | 260/567.6 P |
| 4,026,945 | 5/1977 | Green et al. | 260/567.6 P |
| 4,407,791 | 10/1983 | Stark | 424/80 |
| 4,414,127 | 11/1983 | Fu | 252/95 |
| 4,462,922 | 7/1984 | Boskamp | 252/174.12 |
| 4,525,346 | 6/1985 | Stark | 424/80 |
| 4,537,706 | 8/1985 | Severson, Jr. | 252/545 |
| 4,550,022 | 10/1985 | Garabedian et al. | 424/127 |
| 4,614,549 | 9/1986 | Ogunbiyi et al. | 134/19 |
| 4,615,882 | 10/1986 | Stockel | 424/80 |
| 4,659,733 | 4/1987 | DuPriest et al. | 514/436 |
| 4,755,528 | 7/1988 | DuPriest et al. | 514/436 |
| 4,758,595 | 7/1988 | Ogunbiyi et al. | 514/635 |
| 4,775,424 | 10/1988 | Wisotzki | 134/42 |
| 4,836,986 | 6/1989 | Ogunbiyi et al. | 422/28 |
| 5,041,435 | 8/1991 | Morita et al. | 514/211 |
| 5,061,734 | 10/1991 | Mao et al. | 514/712 |
| 5,089,163 | 2/1992 | Aronson et al. | 252/135 |
| 5,096,607 | 3/1992 | Mowrey-McKee | 252/106 |
| 5,209,783 | 5/1993 | Huth et al. | 134/19 |
| 5,281,277 | 1/1994 | Nakagawa et al. | 134/18 |
| 5,330,752 | 7/1994 | Park et al. | 424/94.4 |
| 5,356,555 | 10/1994 | Huth et al. | 252/106 |
| 5,399,573 | 3/1995 | Garner et al. | 514/369 |

FOREIGN PATENT DOCUMENTS

| | | |
|---|---|---|
| 1150907 | 8/1983 | Canada . |
| 0456467A2 | 11/1991 | European Pat. Off. . |
| 57-24526 | 5/1982 | Japan . |
| 4-143718 | 5/1992 | Japan . |
| 4-243215 | 8/1992 | Japan . |
| 4-370197 | 12/1992 | Japan . |

OTHER PUBLICATIONS

Benedek, G. B., "Theory of Transparency of the Eye", *Applied Optics,* vol. 10, No. 3, pp. 459–473 (1971).

Spector, A., "The Search for a Solution to Senile Cataracts Proctor Lecture", *Investigative Ophthalmology & Visual Science,* vol. 25, No. 2, pp. 130–146 (1984).

Dickerson Jr., et al., "A new mixed disulfide species in human cataractous and aged lenses", *Biochimica et Biophysica Acta,* vol. 1157, pp. 141–146 (1993).

Lou, M., et al., "The Role of Protein–Thiol Mixed Disulfides in Cataractogenesis", *Experimental Eye Research,* vol. 50, pp. 819–826 (1990).

Babizhayev, M., et al., "Peroxide–metabolizing systems of the crystalline lens", *Biochimica et Biophysica Acta,* vol. 1138, pp. 11–19 (1992).

Varma, S., "Scientific basis for medical therapy of cataracts by antioxidants", *American Journal of Clinical Nutrition,* vol. 53, pp. 335S–345S (1991).

Jacques, P., et al., "Epidemiologic evidence of a role for the antioxidant vitamins and carotenoids in cataract prevention", *American Journal of Clinical Nutrition,* vol. 53, pp. 352S–355S (1991).

Maitra, I., et al., "α–Lipoic Acid Prevents Buthionine Sulfoximine–Induced Cataract Formation In Newborn Rats", *Free Radical Biology & Medicine,* vol. 8, No. 4, pp. 823–829 (1995).

Singh, R., et al., "A Reagent for Reduction of Disulfide Bonds in Proteins That Reduces Disulfide Bonds Faster Than Does Dithiothreitol", *Journal of Organic Chemistry,* vol. 56, pp. 2332–2337 (1991).

Zigler, J., et al., "Cataracts in the Royal College of Surgeons Rat: Evidence for Initiation by Lipid Peroxidation Products", *Experimental Eye Research,* vol. 41, pp. 67–76 (1985).

Lou, M., et al., "Quantiation of Lens Mixed Disulfides By Ion–exchange Chromatography", *Experimental Eye Research,* vol. 42, pp. 607–616 (1986).

Lou, M., et al., "Protein–Thiol Mixed Disulfides in Human Lens", *Experimental Eye Research,* vol. 55, pp. 889–896 (1992).

Lou, M., et al., "Effect of opacification and pigmentation on human lens protein thiol/disulfide and solubility", *Current Eye Research,* vol. 8, pp. 883–890 (1989).

Lo, J.; Silverman, H.; and Korb, D.; "Studies on cleaning solutions for contact lenses", *Journal of the American Optometric Association,* vol. 40, No. 11 (1969), 1106–1109.

*Primary Examiner*—Paul Lieberman
*Assistant Examiner*—Kery A. Fries
*Attorney, Agent, or Firm*—Michael C. Mayo; James A. Arno; Gregg C. Brown

[57] ABSTRACT

Compositions containing an ophthalmically acceptable enzyme of high purity and integrity in a liquid medium and methods involving the use of these compositions for cleaning a contact lens, and in combination with an antimicrobial agent for the simultaneous cleaning and disinfecting of contact lens are disclosed.

17 Claims, No Drawings

STABLE LIQUID ENZYME COMPOSITIONS AND METHODS OF USE

BACKGROUND OF THE INVENTION

The present invention relates to the field of contact lens cleaning and disinfecting. In particular, this invention relates to compositions containing liquid suspensions (presolubilized) of enzymes and methods for cleaning human-worn contact lenses with those compositions. The invention also relates to methods of simultaneously cleaning and disinfecting contact lenses by combining the liquid enzyme compositions of the present invention with a chemical disinfecting agent.

Various compositions and methods for cleaning contact lenses have been described in the patent and scientific literature. Some of these methods have employed compositions containing surfactants or enzymes to facilitate the cleaning of lenses. The first discussion of the use of proteolytic enzymes to clean contact lenses was in an article by Lo, et al. in the *Journal of The American Optometric Association,* volume 40, pages 1106–1109 (1969). Methods of removing protein deposits from contact lenses by means of proteolytic enzymes have been described in many publications since the initial article by Lo, et al., including U.S. Pat. No. 3,910,296 (Karageozian, et al.).

Numerous compositions and methods for disinfecting contact lenses have also been described. Those methods may be generally characterized as involving the use of heat and/or chemical agents. Representative chemical agents for this purpose include organic antimicrobials such as benzalkonium chloride and chlorhexidine, and inorganic antimicrobials such as hydrogen peroxide and peroxide-generating compounds. U.S. Pat. Nos. 4,407,791 and 4,525,346 (Stark) describe the use of polymeric quaternary ammonium compounds to disinfect contact lenses and to preserve contact lens care products. U.S. Pat. Nos. 4,758,595 and 4,836,986 (Ogunbiyi) describe the use of polymeric biguanides for the same purpose.

Various methods for cleaning and disinfecting contact lenses at the same time have been proposed. Such methods are described in U.S. Pat. Nos. 3,873,696 (Randeri, et al.) and 4,414,127 (Fu), for example. A representative method of simultaneously cleaning and disinfecting contact lenses involving the use of proteolytic enzymes to remove protein deposits and a chemical disinfectant (monomeric quaternary ammonium compounds) is described in Japanese Patent Publication 57-24526 (Boghosian, et al.). The combined use of a biguanide (i.e., chlorhexidine) and enzymes to simultaneously clean and disinfect contact lenses is described in Canadian Patent No. 1,150,907 (Ludwig). Methods involving the combined use of dissolved proteolytic enzymes to clean and heat to disinfect are described in U.S. Pat. No. 4,614,549 (Ogunbiyi). The combined use of proteolytic enzymes and polymeric biguanides or polymeric quaternary ammonium compounds is described in copending, and commonly assigned U.S. patent application Ser. No. 08/156,043 and in corresponding European Patent Application Publication No. 0 456 467 A2.

The commercial viability of prior enzyme/disinfectant combinations has depended on the use of a stable enzyme tablet. More specifically, the use of solid enzymatic cleaning compositions has been necessary to ensure stability of the enzymes prior to use. In order to use such compositions, a separate packet containing a tablet must be opened, the tablet must be placed in a separate vial containing a solution, and the tablet must be dissolved in order to release the enzyme into the solution. This practice is usually performed only once a week due to the cumbersome and tedious procedure and potential for irritation and toxicity. Moreover, the enzymatic cleaning tablets contain a large amount of excipients, such as effervescent agents (e.g., bicarbonate) and bulking agents (e.g., compressible sugar). As explained below, such excipients can adversely affect both cleaning and disinfection of the contact lenses.

There have been prior attempts to use liquid enzyme compositions to clean contact lenses. However, these attempts have been hampered by the fact that aqueous liquid enzyme compositions are inherently unstable. When a proteolytic enzyme is placed in an aqueous solution for an extended period (i.e., several months or more), the enzyme may lose all or a substantial portion of its proteolytic activity. Steps can be taken to stabilize the compositions, but the use of stabilizing agents may have an adverse effect on the is activity of the enzyme. For example, stabilizing agents can protect enzymes from chemical instability problems during storage in an aqueous liquid, by placing the enzymes in a dormant physical conformation. This comformation is referred to herein as being "partially denatured." However, these agents may also inhibit the ability of the enzymes to become active again (i.e., become "renatured") at the time of use. Finally, in addition to the general problems referred to above, a commercially viable liquid enzyme preparation for treating contact lenses must be relatively nontoxic, and must be compatible with other chemical agents used in treating contact lenses, particularly antimicrobial agents utilized to disinfect the lenses.

The following patents may be referred to for further background concerning prior attempts to stabilize liquid enzyme formulations: U.S. Pat. Nos. 4,462,922 (Boskamp); 4,537,706 (Severson); and 5,089,163 (Aronson). These patents describe detergent compositions containing enzymes. The detergent compositions may be used to treat laundry, as well as other industrial uses. Such detergents are not appropriate for treating contact lenses. The compositions of the present invention do not contain a detergent, or other agents potentially damaging or irritating to the eye.

U.S. Pat. No 5,281,277 (Nakagawa) and Japanese Kokai Patent Applications Nos. 92-370197; 92-143718; and 92-24325 describe liquid enzyme compositions for treating contact lenses. The compositions of the present invention are believed to provide significant improvements relative to the compositions described in those publications.

SUMMARY OF THE INVENTION

The present invention provides for compositions for cleaning contact lenses containing enzymes of high purity and integrity and methods for using the compositions. This high purity and integrity limits 1) the number of different potential antigenic substances on a contact lens; 2) the quantity of potential antigenic substances on a contact lens and 3) the unstabilizing feature of cross-degredation by disimilar enzymes in liquid compositions.

The present invention is based in part on the finding that particular liquid enzyme compositions possess stability, preservative efficacy, and, when used in conjunction with a physiologically compatible, disinfecting solution, provide a good comfort and safety profile. Thus, the present invention has overcome issues of toxicity and efficacy to provide a more effective, yet physiologically delicate, system for cleaning contact lenses.

The compositions and methods of the present invention provide greater ease of use, and therefore, greater user compliance. This ease of use enables contact lens users to clean their lenses 2 to 3 times a week, or more preferably, every day. It has been found that daily use of the liquid enzyme compositions of the present invention results in dramatically better cleaning and safety, as compared to the once-a-week enzyme cleaning regimens currently being utilized.

The liquid enzyme compositions of the present invention contain critical amounts of selected stabilizing agents. The stabilizing agents utilized are combinations of a borate compound and one or more 2–3 carbon polyols. The amounts of stabilizing agents utilized have been delicately balanced, such that maximum stability is achieved, while maximum activity is later obtained when the composition is put into use. Furthermore, the use of borate compound also provides preservation of the liquid enzyme compositions of the present invention when the compositions are packaged in multiple use containers.

The present invention also provides methods for cleaning contact lenses with the above described liquid enzyme compositions. In order to clean a soiled lens, the lens is placed in a few milliliters of an aqueous solution and a small amount, generally one to two drops, of the enzyme composition is added to the solution. The lens is then soaked in the resultant cleaning solution for a time sufficient to clean the lens. Significantly, the use of the above described compositions has only a minor impact on the osmolality of the disinfecting solution, and thus little to no effect on the antimicrobial efficacy of the disinfecting solution. As used in the methods of the present invention, 1 drop of the above described compositions contributes only about 40 milliOsmoles per kilogram (mOs/kg) to about 5 mL of disinfecting solution, while prior tablet compositions contribute 100 to 200 or more mOs/kg to the same solution, due to excipients needed to promote effervescing dissolution or to add bulk.

DETAILED DESCRIPTION OF THE INVENTION

The enzymes which may be utilized in the compositions and methods of the present invention include all enzymes which: (1) are useful in removing deposits from contact lenses; (2) cause, at most, only minor ocular irritation in the event a small amount of enzyme contacts the eye as a result of inadequate rinsing of a contact lens; (3) are relatively chemically stable and effective in the presence of the antimicrobial agents described below; and (4) do not adversely affect the physical or chemical properties of the lens being treated. For purposes of the present specification, enzymes which satisfy the foregoing requirements are referred to as being "ophthalmically acceptable."

While Applicants do not wish to be bound by any theory, it is believed that the stability of these enzymes is enhanced by partially denaturing the proteins. The enzymes are partically denatured by forming a complex with the stabilizing agents. The enzymes are denatured to a point where the enzymes are inactivated, but where renaturation is easily achieved by dilution of the denatured enzyme/stabilizing agent complex in an aqueous medium. It is believed that the stabilizing agents compete with water for hydrogen bonding sites on the proteins. Thus, a certain percentage of these agents will effectively displace a certain percentage of water molecules. As a result, the proteins will change conformation (partially denature) to an inactive and complexed (with the stabilizing agents) form. When the enzyme is in an inactive form, it is prevented from self-degradation and other spontaneous, chemically irreversible events. On the other hand, displacement of too many water molecules results in protein conformational changes that are irreversible. In order to obtain a stable liquid enzyme composition of significant shelf life and thus commercial viability, a delicate balance point of maximum stability and maximum reversible renaturation must be ascertained. Such a point has now been discovered.

It has been found that the use of a polyol in combination with a borate compound achieves the stability and sustainable activity required in the liquid enzyme compositions of the present invention. The polyols utilized in the present invention are 2–3 carbon polyols. The most preferred borate is sodium borate. As used herein, the term "2–3 carbon polyol" refers to a compound with 2 to 3 carbon atoms and at least two hydroxy groups. Examples of 2–3 carbon polyols are glycerol, 1,2-propylene glycol, 1,3-propylene glycol and ethylene glycol. Examples of borate compounds are alkali metal salts of borate, boric acid and borax. As mentioned above, the borate compound also contributes to the anti-microbial preservation of the liquid enzyme compositions of the present invention to a level effective for multi-use dispensing.

Furthermore, it has been found that certain percentages (weight/volume) of a 2–3 carbon polyol and a borate compound are critical for obtaining the stability and sustainable activity required in the liquid enzyme compositions of the present invention. It has been discovered that the combination of 50–70% of a 2–3 carbon polyol and 4–8% of a borate compound is required to achieve the necessary criteria for efficacious and commercially viable liquid enzyme compositions, as described above. The combination of about 50% of a 2–3 carbon polyol and about 7.6% sodium borate is most preferred. Examples 1, and 2 below, further illustrate appropriate and inappropriate concentrations of these stabilizing agents.

The proteolytic enzymes used herein are required to be of high purity and integrity. The enzymes of compositions of the present invention exhibit high gel electrophoretic ratios. As used herein, the term "high gel electrophoretic ratios" refers to a ratio of at least 99:1 of the amount of the band of a proteolytic enzyme of the present invention to the amount of all other bands of material separated on the gel. The enzymes of the present invention also exhibit a substantially undenatured integrity. As used herein, the term "substantially undenatured integrity" refers to activity related to 95% of total protein.

High purity and integrity enzymes can be obtained commercially. Various companies sell such enzymes including: NovoNordsk (Bagsvaerd, Denmark) and Sigma Chemical Co. (St. Louis, Mo., U.S.A.). Alternatively, a crude enzyme can be purified and selected for substantially undenatured portions by typical methods known by those skilled in the art. For example, the use of column chromatography and crystallization techniques can generally be used to purify enzymes of the present invention.

The proteolytic enzymes used herein must have at least a partial capability to hydrolyze peptide-amide bonds in order to reduce the proteinaceous material found in lens deposits to smaller water-soluble subunits. Typically, such enzymes will exhibit some lipolytic, amylolytic or related activities associated with the proteolytic activity and may be neutral, acidic or alkaline. In addition, separate lipases or carbohydrases may be used in combination with the proteolytic enzymes, as well as thermally stable proteases.

Examples of suitable proteolytic enzymes include but are not limited to trypsin, subtilisin, collagenase, keratinase, carboxylase, aminopeptidase, Aspergillo peptidase, pronase E (from *S. griseus*) and dispase (from Bacillus, polymyxa) and mixtures thereof.

Microbial derived enzymes, such as those derived from Bacillus, Streptomyces, and Aspergillus microorganisms, represent one type of enzyme which may be utilized in the present invention. Of this sub-group of enzymes, the most preferred are the Bacillus derived alkaline proteases generically called "subtilisin" enzymes.

The identification, separation and purification of enzymes is known in the art. Many identification and isolation techniques exist in the general scientific literature for the isolation of enzymes, including those enzymes having proteolytic and mixed proteolytic/amylolytic or proteolytic/lipolytic activity. The enzymes contemplated by this invention can be readily obtained by known techniques from plant, animal or microbial sources.

With the advent of recombinant DNA techniques, it is anticipated that new sources and types of stable proteolytic enzymes will become available. Such enzymes should be considered to fall within the scope of this invention so long as they meet the criteria for stability and activity set forth herein.

Subtilisin and trypsin are preferred enzymes for use in the present invention. Subtilisin is derived from Bacillus bacteria and is commercially available from various commercial sources including Novo Industries (Bagsvaerd, Denmark), Fluka Biochemika (Buchs, Germany and Boehringer Mannheim. Trypsin is purified from various animal sources and is commercially available from Sigma Chemical Co. and Boehringer Mannheim.

The methods of the present invention involve the use of an amount of enzyme effective to remove substantially or to reduce significantly deposits of proteins, lipids, mucopolysaccharides and other materials typically found on human-worn contact lenses. For purposes of the present specification, such an amount is referred to as "an amount is effective to clean the lens." The amount of enzyme or enzymes utilized in particular embodiments of the present invention may vary, depending on various factors, such as the proposed duration of exposure of lenses to the enzymes, the nature of the lens care regimen (e.g., the frequency of lens disinfection and cleaning), the type of lens being treated, and the use of adjunctive cleaning agents (e.g., surfactants).

The liquid enzyme compositions of the present invention must be formulated to provide storage stability and preservation suitable for multiple use dispensing. Additionally, when combined with a disinfecting solution containing an antimicrobial agent which is adversely affected by high ionic strength such as polyquaternium-1, the compositions of the present invention must exhibit low osmolality, tonicity and pH effects on the disinfecting solution, and provide effective enzymatic activity to breakdown and hence remove proteinaceous, sebaceous, and other foreign deposits on the contact lens. Finally, the liquid enzyme compositions must not contribute to the adverse effects of deposit formation on the lens, ocular irritation, or immunogenecity from continuous use.

As used in the present specification, the term "low osmolality effect" is defined as an increase in osmolality of about 0–50 milliOsmoles/kg when 1 to 2 drops of the liquid enzyme composition is added to the diluent solution. Osmolality is an indirect measure of available $H_2O$ hydrogen bonding and ionic strength of a solution. It is convenient to utilize osmolality measurements to define acceptable tonicity ranges for disinfecting solutions. The antimicrobial activity of disinfecting agents, particularly polymeric quaternary ammonium compounds such as polyquaternium-1, is adversely affected by high concentrations of sodium chloride or other ionic solutions.

The ionic strength or tonicity of the cleaning and disinfecting solution of the present invention has been found to be an important factor. More specifically, polymeric ammonium compounds, and particularly those of Formula (I), below, lose antimicrobial activity as the ionic strength of the solution is increased. The use of solutions having low ionic strength is therefore preferred. Such low ionic strengths correspond to a tonicity in the range of 150 to 350 milliOsmoles per kilogram (mOs/kg), with a range of 200 to 300 mOs/kg being more preferred and a tonicity of 220 mOs/kg being most preferred. The tonicity of the solution may be affected by various components of the solution, but it is generally a function of the sodium chloride concentration.

The liquid enzyme composition of the present invention must demonstrate effective cleaning efficacy while exhibiting minimal, or more preferably, enhanced effects on the anti-microbial efficacy of the disinfecting solution to which it is combined. It has unexpectedly been discovered that the liquid enzyme compositions of the present invention enhance the antimicrobial activity of disinfecting solutions containing polyquaternium-1, a polymeric quaternary ammonium disinfecting agent. In addition, the antimicrobial activity of the enzyme and antimicrobial agent combination has surprisingly been found to become even more effective than the antimicrobial agent alone when lenses are treated for extended periods of approximately one hour to overnight, with four to eight hours preferred. Since, for the sake of convenience, contact lenses are typically soaked overnight in order to be cleaned with enzymes or disinfected with chemical agents, this finding has practical significance.

While Applicants do not wish to be bound by any theory, it is believed that the above described effects are due to the disruption or lysis of microbial membranes by the enzyme, and is further attributable to the negligible impact of the compositions on the ionic strength of the disinfecting solution. As described above, a range of ionic strength, expressed in osmolality units, is critical for the antimicrobial efficacy of polymeric disinfecting agents. While the liquid enzyme cleaning compositions of the present invention have a high osmolality, due to the high concentration of a 2–3 carbon polyol, only 1 to 2 drops (approximately 30–60 uL) of the compositions are added to 2–10 mL of a disinfecting solution. The addition of 1 drop of compositions of the present invention to 5 mL of a disinfecting solution increases the osmolality by about 40 mOsm/kg. Furthermore, this contribution to osmolality is primarily non-ionic. Therefore, the contribution of the compositions to the final ionic strength and osmolality of the enzyme/disinfectant solution is minor and is considered negligible.

The methods of the present invention utilize a disinfecting solution containing an antimicrobial agent. Antimicrobial agents can be oxidative, such as hydrogen peroxide, or non-oxidative polymeric antimicrobial agents which derive their antimicrobial activity through a chemical or physiochemical interaction with the organisms. As used in the present specification, the term "polymeric antimicrobial agent" refers to any nitrogen-containing polymer or copolymer which has antimicrobial activity. Preferred polymeric antimicrobial agents include: polymeric quaternary ammonium compounds, such as disclosed in U.S. Pat. Nos.

3,931,319 (Green, et al.), 4,026,945 (Green, et al.) and 4,615,882 (Stockel, et al.) and the biguanides, as described below. The entire contents of the foregoing publications are hereby incorporated in the present specification by reference. Other antimicrobial agents suitable in the methods of the present invention include: benzalkonium halides, and biguanides such as salts of alexidine, alexidine free base, salts of chlorhexidine, hexamethylene biguanides and their polymers. The antimicrobial agents used herein are preferably employed in the absence of mercury-containing compounds such as thimerosal. The salts of alexidine and chlorhexidine can be either organic or inorganic and are typically gluconates, nitrates, acetates, phosphates, sulphates, halides and the like.

Particularly preferred are polymeric quaternary ammonium compounds of the structure:

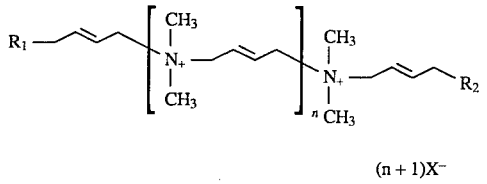

(I)

wherein:

$R_1$ and $R_2$ can be the same or different and are selected from:

$N^+(CH_2CH_2OH)_3X^-$, $N(CH_3)_2$ or OH;

X is a pharmaceutically acceptable anion, preferably chloride; and n=integer from 1 to 50.

The most preferred compounds of this structure is polyquaternium-1, which is also known Onamer M™ (registered trademark of Onyx Chemical Corporation) or as Polyquad® (registered trademark of Alcon Laboratories, Inc.). Polyquaternium-1 is a mixture of the above referenced compounds, wherein X is chloride and $R_1$, $R_2$ and n are as defined above.

The above-described antimicrobial agents are utilized in the methods of the present invention in an amount effective to eliminate substantially or to reduce significantly the number of viable microorganisms found on contact lenses, in accordance with the requirements of governmental regulatory agencies, such as the U.S. Food and Drug Administration. For purposes of the present specification, that amount is referred to as being "an amount effective to disinfect" or "an antimicrobial effective amount." The amount of antimicrobial agent employed will vary, depending on factors such as the type of lens care regimen in which the method is being utilized. For example, the use of an efficacious daily cleaner in the lens care regimen may substantially reduce the amount of material deposited on the lenses, including microorganisms, and thereby lessen the amount of antimicrobial agent required to disinfect the lenses. The type of lens being treated (e.g., "hard" versus "soft" lenses) may also be a factor. In general, a concentration in the range of about 0.000001% to about 0.01% by weight of one or more of the above-described antimicrobial agents will be employed. The most preferred concentration of the polymeric quaternary ammonium compounds of Formula (I) is about 0.001% by weight.

Oxidative disinifecting agents may also be employed in the methods of the present invention. Such oxidative disinfecting agents include various peroxides which yield active oxygen in solution. Preferred methods will employ hydrogen peroxide in the range of 0.3 to 3.0% to disinfect the lens. Methods utilizing an oxidative disinfecting system are described in U.S. Pat. No. Re 32,672 (Huth, et al.) the entire contents of which, are hereby incorporated in the present specification by reference.

The disinfecting solutions used with the present invention may contain any of the components of the above-mentioned liquid enzyme compositions as well as other components, but typically will contain water, antimicrobial agents, one or more suitable buffering agents, chelating and/or sequestering agents and tonicity adjusting agents. The disinfecting solutions may also contain surfactants.

Suitable surfactants can be either cationic, anionic, nonionic or amphoteric. Preferred surfactants are neutral or nonionic surfactants which may be present in amounts up to 5% (w/v). Examples of suitable surfactants include, but are not limited to, polyethylene glycol esters of fatty acids, polyoxypropylene ethers of $C_{12}$–$C_{18}$ alkanes and polyoxyethylene, polyoxypropylene block copolymers of ethylene diamine (i.e. poloxamine).

Examples of preferred chelating agents include ethylenediaminetetraacetic acid (EDTA) and its salts (e.g., disodium) which are normally employed in amounts from about 0.025 to about 2.0% (w/v). Other known chelating (or sequestering agents) such as certain polyvinyl alcohols can also be employed.

The methods of the present invention will typically involve adding a small amount, e.g., 1 to 2 drops, of a liquid enzyme composition of the present invention to about 2 to 10 mL of disinfecting solution, placing the soiled lens into the enzyme/disinfectant solution, and soaking the lens for a period of time effective to clean and disinfect the lens. The soiled lens can be placed in the disinfecting solution either before or after the addition of the liquid enzyme composition. Optionally, the contact lenses are first rubbed with a non-enzymatic daily surfactant cleaner prior to immersion in the enzyme/disinfectant solution. The lens will typically be soaked overnight, but shorter or longer durations are contemplated by the methods of the present invention. The methods of the present invention allow the above-described regimen to be performed once per week, but more preferably, every day.

The following examples are presented to illustrate further, various aspects of the present invention, but are not intended to limit the scope of the invention in any respect.

EXAMPLE 1

A specific liquid subtilisin composition of the present invention, and a suitable disinfecting solution for use in combination with that composition, are described below:

A. Liquid Subtilisin Composition

The following liquid enzyme formulation represents a preferred embodiment of the present invention:

| Ingredient | amount |
|---|---|
| Subtilisn | 0.1% (w/v)* |
| Sodium borate | 7.62% (w/v) |
| Propylene glycol | 50% (v/v) |
| Water | QS |
| Hydrochloric acid/sodium hydroxide | QS* |

*corresponds to an amount to adjust the pH to 6.0

Note:

(w/v) means weight/volume; (v/v) means volume/volume; and QS means quality sufficient The above formulation was prepared by first sequentially mixing propylene glycol, purified water, hydrochloric acid and sodium borate together. The solution was polish filtered (1.2 mm filter) into a sterile receiving tank, and then sterile filtered (0.2 mm filter). The required amount of pancreatin was then dissolved an appropriate amount of water and the solution was polished filtered (0.6 mm filter). This enzyme solution was then sterile filtered (0.2 mm filter) into the sterile receiving tank containing the sterilized propylene glycol/sodium borate solution. With appropriate mixing, the contents of the receiving tank were then brought to volume with an appropriate amount of water. The optimal pH of the above formulation was in the range of 6–7, a pH of 6 is most preferred.

B. Disinfecting Solution

The following formulation represents a preferred disinfecting solution:

| Ingredient | weight/volume (%) |
|---|---|
| Polyquaternium-1 | 0.001 + 10% excess |
| Sodium chloride | 0.48 |
| Disodium Edetate | 0.05 |
| Citric acid monohydrate | 0.021 |
| Sodium citrate dihydrate | 0.56 |
| Purified water | QS |

To prepare the above formulation, sodium citrate dihydrate, citric acid monohydrate, disodium edetate, sodium chloride and Polyquaternium-1, in the relative concentrations indicated above, were mixed with purified water and the components allowed to dissolve by stirring with a mixer. Purified water was added to bring the solution to almost 100%. The pH was recorded at 6.3 and adjusted to 7.0 with NaOH. Purified water was added to bring the solution to 100%. The solution was stirred and a pH reading of 7.0 was taken. The solution was then filtered into sterile bottles and capped.

EXAMPLE 2

A preferred liquid trypsin composition of the present invention for use in combination with a suitable disinfecting solution, e.g. EXAMPLE 1B., are described below:

| Liquid Tryspin Compositions | |
|---|---|
| Ingredient | amount |
| Tryspin | 0.3% (w/v) |
| Sodium borate | 7.62% (w/v) |
| Propylene glycol | 50% (v/v) |
| Water | QS |
| Hydrochloric acid/sodium hydroxide | QS* |

*corresponds to an amount to adjust the pH to 6.0

The above liquid trypsin compositions are made in the same manner as the liquid subtilisin composition, described in EXAMPLE 1, are made.

EXAMPLE 3

A stability study comparing the trypsin and pancreatin in the liquid enzyme composition of EXAMPLE 1, wherein trypsin, at 0.3% weight/volume, and pancreatin, at 1.7% w/v was substituted for subtilisin. The data are shown in Table I below. Aliquots of the compositions were stored in a chamber held to 35° C. At the appointed time, aliquots were tested for enzyme activity by the casein-digestion method described above. Activity levels were compared with initial levels and expressed as percent remaining activity.

TABLE I

STABILITY OF LIQUID ENZYME COMPOSITIONS CONTAINING TRYSPIN OR CHYMOTRYSPIN STORED AT 35° C.

| | % Remaining Activity | |
|---|---|---|
| Time | Tryspin | Pancreatin |
| 24 hours | 100 | 83.0 |
| 1 weeks | 100 | 76.5 |
| 2 weeks | 96.0 | 81.1 |
| 3 weeks | 93.2 | 80.2 |
| 4 weeks | 93.2 | 78.3 |

The trypsin composition demonstrated an excellent stability profile at 35 C., whereas the multiple enzyme pancreatin, containing trypsin, chymotrypsin, lipas, amylase and carboxypeptidase, was less stable.

EXAMPLE 4

The disinfecting efficacy of a composition of the present invention was evaluated by determining the rate and extent of kill achieved with an aqueous system formed by combining the liquid enzyme composition and disinfecting solution described in EXAMPLE 1 above. That system was tested against *Serratia marcescens*. The test procedures and results are described below.

A 0.1 ml volume of inoculum ($10^8$ colony forming units/mL) was first added to a 10 ml volume of the disinfecting solution of EXAMPLE 1, followed by the addition of 2 drops of the liquid enzyme composition of EXAMPLE 1. A similarly inoculated 10 ml volume of the disinfecting solution of EXAMPLE 1 was used as a control. The solutions were maintained at room temperature throughout the test. Each microorganism and test solution was tested individually. Sets of four replicate (n=8) samples were tested for each organism.

At selected time intervals of 4 and 24 hours a 1 ml volume of the inoculated test solution was removed and appropriate serial dilutions were made in sterile 0.9% sodium chloride solution dilution blanks. Pour-plates were prepared with soybean-casein digest agar containing 0.07% Asolectin and 0.5% Polysorbate 80. At Time 0, a 1.0 ml volume of the saline control was removed and serial dilution pour-plates were prepared using the same recovery medium and dilution blanks. The Time 0 saline control count was used as the initial count. The pour-plates were incubated at 30°–35° C. for appropriate incubation periods. The number of surviving organisms at each time interval was then determined. The results are summarized in Tables II below.

TABLE X

EFFECTS OF A SUBTILISIN CONTAINING LIQUID ENZYME COMPOSITION ON THE ANTIMICROBIAL ACTIVITY OF A POLYQUATERNIUM-1 DISINFECTING SOLUTION

| | LOG REDUCTION | |
|---|---|---|
| Time | Disinfecting Solution Control | Liquid Enzyme (subtilisn) + Disinfecting Solution |
| 4 hours | 0.85 ± 0.07 | 1.33 ± 0.15 |
| 24 hours | 3.65 ± 0.35 | 3.37 ± 1.01 |

As illustrated in Table II, the liquid enzyme composition containing subtilisin had an enhancing effect on the antimicrobial activity of the disinfecting solution of EXAMPLE 1 through 4 hours of incubation, and a negligible effect at 24 hours.

The invention in its broader aspects is not limited to the specific details shown and described above. Departures may be made from such details within the scope of the accompanying claims without departing from the principles of the invention and without sacrificing its advantages.

What is claimed is:

1. A stable, concentrated, liquid enzyme composition for cleaning contact lenses comprising:

an enzyme in an amount effective to clean the lens, said enzyme having a gel electrophoretic ratio of at least 99:1; 4–8% weight/volume of a borate compound; 50–70% weight/volume of a 2–3 carbon polyol; and water; wherein the enzyme is substantially undenatured upon dilution in an aqueous solvent.

2. A composition according to claim 1, wherein the enzyme is trypsin.

3. A composition according to claim 1, wherein the borate compound is sodium borate and the 2–3 carbon polyol is 1,2-propylene glycol.

4. A composition according to claim 3, wherein the composition contains 7.6% weight/volume sodium borate and 50% weight/volume 1,2-propylene glycol.

5. A composition according to claim 4, wherein the enzyme is trypsin.

6. A method of cleaning a contact lens which comprises:

placing the lens in an aqueous solvent;

dispersing a small amount of a stable, concentrated, liquid enzyme cleaning composition in the aqueous solvent to form an aqueous enzymatic cleaning solution, said cleaning composition comprising: an enzyme in an amount effective to clean the lens, said enzyme having a gel electrophoretic ratio of at least 99:1; 50–70% weight/volume of a 2–3 carbon polyol, 4–8% weight/volume of a borate compound, and water; and soaking the lens in the enzymatic cleaning solution for a period of time sufficient to clean the lens;

wherein the enzyme is substantially undenatured upon dispersion in the aqueous solvent.

7. A method according to claim 6, wherein the enzyme is trypsin.

8. A method according to claim 6, wherein the borate compound is sodium borate and the 2–3 carbon polyol is 1,2-propylene glycol.

9. A method according to claim 8, wherein the composition contains 7.6% weight/volume sodium borate and 50% weight/volume 1,2-propylene glycol.

10. A method according to claim 9, wherein the enzyme is trypsin.

11. A method according to claim 10, wherein the method is performed daily.

12. A method for cleaning and disinfecting a contact lens which comprises:

placing the lens in an aqueous disinfecting solution containing an amount of an antimicrobial agent effective to disinfect the lens;

dispersing a small amount of a stable, concentrated, liquid enzyme cleaning composition in said disinfecting solution to form an aqueous disinfectant/enzyme solution, said cleaning composition comprising: an enzyme in an amount effective to clean the lens, said enzyme having a gel electrophoretic ratio of at least 99:1, 50–70% weight/volume of a 2–3 carbon polyol, 4–8% weight/volume of a borate compound, and water; and soaking the lens in the aqueous disinfectant/enzyme solution for a period of time sufficient to clean and disinfect the lens;

wherein the enzyme is substantially undenatured upon dispersion in the disinfecting solution.

13. A method according to claim 12, wherein the enzyme is trypsin.

14. A method according to claim 12, wherein the borate compound is sodium borate and the 2–3 carbon polyol is 1,2-propylene glycol.

15.A method according to claim 14, wherein the composition contains 7.6% weight/volume sodium borate and 50% weight/volume 1,2-propylene glycol.

16. A method according to claim 15, wherein the enzyme is trypsin.

17. A method according to claim 16, wherein the method is performed daily.

* * * * *